United States Patent [19]

Bergeron

[11] Patent Number: 4,688,681

[45] Date of Patent: Aug. 25, 1987

[54] FOOT APPAREL STORAGE ASSEMBLY

[76] Inventor: Paul U. Bergeron, 27 Bean Rd., Colchester, Vt. 05446

[21] Appl. No.: 820,164

[22] Filed: Jan. 21, 1986

[51] Int. Cl.[4] ..... A47F 7/08

[52] U.S. Cl. ..... 211/36; 211/195; 211/150

[58] Field of Search ..... 211/34, 35, 38, 36, 211/37, 150, 132, 149, 195; 248/242; 108/6

[56] References Cited

U.S. PATENT DOCUMENTS

| | | | |
|---|---|---|---|
| 1,030,940 | 7/1912 | Subberg | 211/35 |
| 1,386,775 | 8/1921 | Fulford | 211/35 X |
| 1,404,555 | 1/1922 | Smith | 211/35 |
| 1,984,827 | 12/1934 | Derman | 211/35 x |
| 2,285,491 | 6/1942 | Clark | 211/36 |
| 2,294,504 | 9/1942 | Knape | 211/38 |
| 3,151,576 | 10/1964 | Patterson | 108/6 X |
| 3,744,645 | 7/1973 | Hochman | 211/186 X |
| 4,383,722 | 5/1983 | Weber | 211/37 X |

FOREIGN PATENT DOCUMENTS

| | | | |
|---|---|---|---|
| 342348 | 12/1959 | Switzerland | 211/35 |
| 677288 | 2/1950 | United Kingdom | 211/37 |

*Primary Examiner*—Robert W. Gibson, Jr.
*Assistant Examiner*—Sarah A. Lechok Eley
*Attorney, Agent, or Firm*—Thomas N. Neiman

[57] ABSTRACT

The assembly, in the embodiment shown, is adapted for replaceable and operative installation upon the back of a standard door or on a wall space. It comprises a plurality of foldable shelves, which are maintained at an angle, to accomodate a number of shoes or boots and allows dirt and fluid to drain. The shelves are attached to a vertical support frame and they fold inwardly into the frame when not in use. A base collector is positioned at the bottom of the frame in order to retain all materials which are drained from the stored shores. A undershelf storage bin has connectors which allow it to be placed under any of the shelves and to be removed as desired.

1 Claim, 5 Drawing Figures

FIG. 5
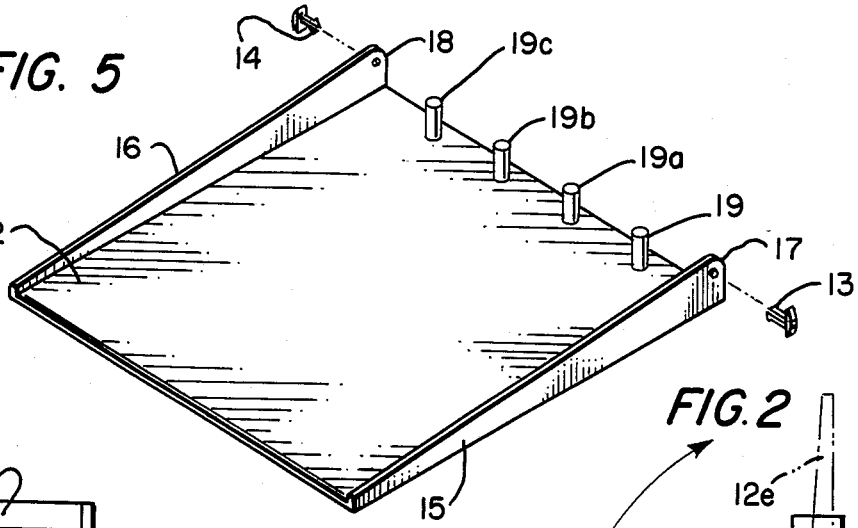
FIG. 1
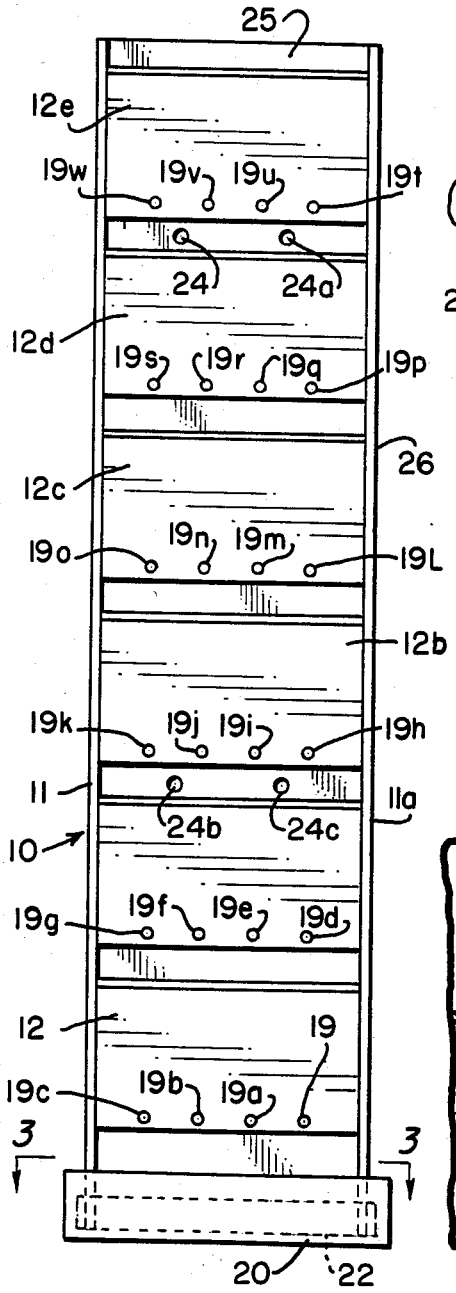
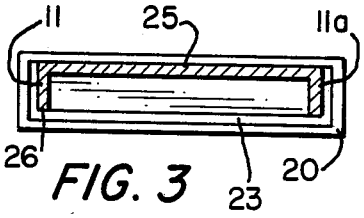
FIG. 3
FIG. 2
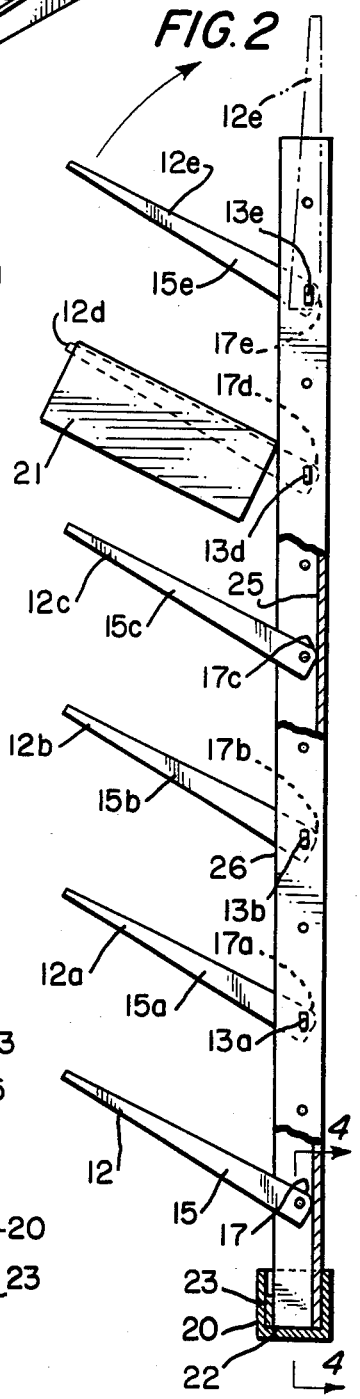
FIG. 4
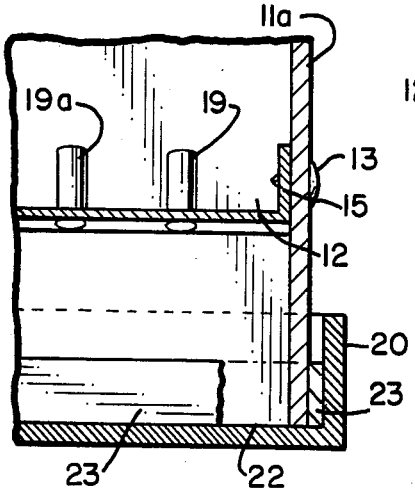

FOOT APPAREL STORAGE ASSEMBLY

BACKGROUND OF THE INVENTION

Invention

1. Field of the invention

This invention pertains to storage assemblies and in particular to a storage assembly which is adapted to be replaceably attached to a wall or the back of a door and provides foldable support means for foot apparel.

2. Description of the prior art

The difficulty that many families face with regard to the storage of shoes and boots that have just been used or have gotten wet or dirty is one that is common to many households. A storage assembly that is out of the way when not in use and yet is very easy to get at in order to avoid tracking water and dirt around the house. Typically, foot apparel support units are those designed to display shoes as shown in the patent issued to T. G. Cummings on July 3, 1917, U.S. Pat No. 1,231,713. This device consists of an expandable , triangular metal form which opens to reveal a shoe display unit. The U.S. Pat. No. 1,030,940 issued to A. M. Subberg on July 2, 1912 for a Shoe Rack a support for shoes in the vertical position. These devices are designed to provide support for foot apparel but they do not replaceably attached foldable assemblies which can be immediately stored or used in one setting.

SUMMARY OF THE INVENTION

It is the object of this invention to teach the use of a foot apparel storage assembly which can be replaceably attached to a door or a wall. It is another object of this invention to teach an assembly which is foldable to be out of the way when not in use.

It is a further object of this invention to provide angled horizontal support for foot apparel to allow for proper drainage of dirt and water into a receptacle for these materials.

An object of this invention is to teach a foot apparel assembly, for replaceable and operative installation thereof on a wall or back of a door or the like, comprising a frame; means defining a plurality of substantially horizontal bearing surfaces, on which to support foot apparel; said bearing surfaces having pivot means, for which to permit said bearing surfaces to fold into said frame; said bearing surfaces having limit stop means, to prevent said foot apparel from contacting said frame; said frame having said catching means at the base of said frame; and means coupled to said bearing surface for providing additional storage capacity.

BRIEF DESCRIPTION OF THE DRAWINGS

Further objects of this invention, as well as the several features thereof, will become more apparent by reference to the following description taken in conjunction with the accompanying figures, in which:

FIG. 1 is a front elevational of the novel assembly with the shelves in the upright position.

FIG. 2 is a side elevational view with the shelves in the extended (open) position, with the storage bin in place;

FIG. 3 is a top cross-sectional view taken along line 3—3 of FIG. 1;

FIG. 4 is an enlarged partial sectional view taken along line 4—4 of FIG. 2; and FIG. 5 is an enlarged perspective view of a support shelf and the pivot means of the novel assembly.

DETAILED DESCRIPTION OF THE DRAWINGS

As shown in the figures, the assembly 10 comprises dual structural vertical beams 11 and 11*a* which comprise with a back plate 25 a channeled support frame 26. The shelves 12 through 12*e* are formed of lightweight solid materials such as metal, wood or plastic. They are connected to the channeled support frame 26 by hinge pins 13 through 13*e* and 14 through 14*e*. These pins go through aperatures in the side of the vertical support beams 11 and 11*a*. Holes are also located in the side ridges 15 through 15*e* and 16 through 16*e* of the shelves. These hinge pins provide a number of functions. They provide the supports which holds the shelves in position in the channeled support frame. Additionally, they allow the shelves to be pivoted upward and inward toward the channeled support frame so that the shelves can placed in a vertical (closed) position within the channeled support frame when the shelves are not in use. It should also be noted that the form or shape of the inner edge 17 through 17*e* and 18 through 18*e* of the side ridges of the shelves will prevent the shelves from reaching the a fully horizontal position when being extended (opened) from the vertical (closed) position. Each shelf has a plurality of perpendicular extensions 19 through 19*w* projecting from the inner portion of each shelf. These projections are designed to prevent footware from sliding foward and contacting the vertical frames or the back plate and can be doweled pieces of wood or molded plastic. A bottom cap 20 for dirt or water is located at the base of the channeled support frame for ease of removal and cleaning of material that is channeled and caught in the bottom cap. A storage bin 21 for mittens and hats can be slid into position on the underside of the shelves 12 by means of u-shaped connectors which go over the ridges 15 and 16 of the shelves. The base 22 has reinforcing structure 23 to steady and improve the stability of the unit. The assembly 10 can be attached to a door or wall by means of screws 24 through 24*c*. Alternative methods of placing the assembly include hooking the unit over the back of the door with a U-type connectors attached to the top of the assembly.

DETAILED DESCRIPTION OF THE PREFERRED EMBODIMENTS

In operation, the user of the assembly would locate the device in a position just inside an outer door. The assembly would be attached to a wall or to the back of the door. The shelves would be would be folded upward vertically into a channel frame. As users come in from playing or working outside, they would remove their shoes or boots, extend the shelf and place their foot apparel on the extended shelf. The angle of the shelf will allow water and dirt to drain toward the channeled support frame and then be carried by gravity into the bottom cap. When the shelf is not in use, it is folded back into the channeled support frame. The cap is removed as necessary in order to empty and clean the unit. A storage bin for hats and gloves can be positioned underneath the shelf by sliding the u-shaped connectors over the side edges of the shelves.

Accordingly, while I have described my method in connection with a specific embodiment thereof, it is clearly to be understood that this is done only by way of example and not as a limitation to the scope of my invention as set forth in the objects therof and in the claims.

I claim:

1. A foot apparel storage assembly, for replaceable and operative installation thereof on a wall or back of a door or the like, comprising:

a frame;

said frame has attachment means for securing said frame to a door frame or the like;

means defining a plurality of horizontal bearing surfaces, on which to support foot apparel; said bearing surface having an inside edge adjacent said frame and an outside edge remote therefrom and side edges having upstanding ridges, said bearing surfaces having pivot means, for which to permit said bearing surfaces to fold into said frame;

said bearing surfaces having limit stop means, to prevent said foot apparel from contacting said frame;

said frame having catching means at the base of said frame;

means coupled to said bearing surfaces for providing additional storage capacity;

said frame has at least one vertical structural beam;

said frame further includes a rear support panel;

said bearing surfaces are connected to said frame by said pivot means on inside edge of said bearing surfaces;

said outside edge of said bearing surface is maintained on a plane above that of said inside edge of said bearing surface;

said bearing surfaces having said pivot means which permit said outside edges to rotate upwardly and inwardly into said frame;

said bearing surfaces include side restrictor means;

said restrictor means has means for maintaining said outside edge of said bearing surface on a slightly elevated position when the bearing surfaces is folded outward;

said maintaining means comprises the tapering of the form of said bearing surfaces;

said limit stop means comprise a plurality of perpendicular extensions comprising a plurality of dowels or the like located on the inside portion of said bearing surfaces;

said catching means defines a rectangular enclosure;

said enclosure is replaceably engaged to said frame;

said additional storage means has coupling means for slideably attaching said storage means to said ridges on said side edges of said bearing surfaces; and said coupling means comprises preformed u-shaped connectors.

* * * * *